US005839173A

United States Patent [19]

Otrusina

[11] Patent Number: 5,839,173

[45] Date of Patent: Nov. 24, 1998

[54] CONNECTOR RELEASABLE IN ONLY ONE ORIENTATION

[76] Inventor: Edward C. Otrusina, 8118 Nueport Dr. South, Willow Springs, Ill. 60480

[21] Appl. No.: 895,959

[22] Filed: Jul. 17, 1997

[51] Int. Cl.[6] ..... A44B 21/00; A45F 5/00

[52] U.S. Cl. ..... 24/597; 24/3.1; 24/590

[58] Field of Search ..... 24/597, 590, 3.1, 24/3.7, 616, 109; 224/197, 272

[56] References Cited

U.S. PATENT DOCUMENTS

| | | | |
|---|---|---|---|
| 26,949 | 1/1860 | Lewis . | |
| 2,172,924 | 9/1939 | Gwinn, Jr. et al. . | |
| 2,233,071 | 2/1941 | Bangs | 24/590 |
| 2,543,313 | 2/1951 | Dietzgen . | |
| 2,658,650 | 11/1953 | Jasper . | |
| 3,080,634 | 3/1963 | Lindblad . | |
| 3,117,708 | 1/1964 | Goldman . | |
| 3,261,519 | 7/1966 | Horne . | |
| 3,310,271 | 3/1967 | King . | |
| 3,365,756 | 1/1968 | Bayon . | |
| 3,570,078 | 3/1971 | Neumann et al. . | |
| 3,743,147 | 7/1973 | Wilczynski . | |
| 3,797,717 | 3/1974 | Collins . | |
| 3,878,589 | 4/1975 | Schaefer . | |
| 3,934,768 | 1/1976 | Jones . | |
| 4,182,470 | 1/1980 | Atkinson . | |
| 4,213,230 | 7/1980 | Hoen | 24/597 |
| 4,310,111 | 1/1982 | Brent . | |
| 4,362,414 | 12/1982 | Volz . | |
| 4,419,794 | 12/1983 | Horton, Jr. et al. . | |
| 4,458,383 | 7/1984 | Hwang . | |
| 4,587,818 | 5/1986 | Griffin . | |
| 4,605,335 | 8/1986 | Otrusina . | |
| 4,619,020 | 10/1986 | Lecher, Sr. . | |
| 4,676,420 | 6/1987 | Sharp . | |
| 4,718,586 | 1/1988 | Hagino . | |
| 4,754,528 | 7/1988 | Lyons et al. . | |
| 4,757,927 | 7/1988 | Rutty . | |
| 4,821,934 | 4/1989 | Alessi et al. . | |
| 5,054,170 | 10/1991 | Otrusina . | |
| 5,201,858 | 4/1993 | Otrusina . | |
| 5,347,693 | 9/1994 | Otrusina . | |
| 5,504,976 | 4/1996 | Reeves | 24/3.1 |

FOREIGN PATENT DOCUMENTS

| | | | |
|---|---|---|---|
| 2270252 | 3/1994 | United Kingdom | 24/3.1 |

*Primary Examiner*—Victor N. Sakran
*Attorney, Agent, or Firm*—Emrich & Dithmar

[57] ABSTRACT

A connecting apparatus for detachably interconnecting two objects includes male and female structures respectively connectable to the objects. The female structure is of unitary, one-piece construction having parallel planar walls cooperating to define a receptacle therebetween, one wall having an aperture therein communicating with the receptacle and extending to a peripheral edge of the wall for opening thereat to define an entrance. An inclined flexible and resilient cam portion is laterally offset to one side of the entrance and is integral with the one wall and inclined out of the plane thereof toward the other wall. Male structure has a stud projecting therefrom with a part-circular head having a straight side and dimensioned to pass through the entrance so that, in one rotational orientation of the head, it will clear the cam portion to permit free passage into and out of the receptacle. In all other rotational orientations the head will engage the cam portion, flexing it to permit movement of the head into the receptacle, but wedging against it to inhibit movement out of the receptacle.

20 Claims, 2 Drawing Sheets

CONNECTOR RELEASABLE IN ONLY ONE ORIENTATION

BACKGROUND OF THE INVENTION

1. Field of the Invention

The present invention relates to connecting or fastening devices and particularly to a connecting apparatus that permits two objects to be quickly and detachably interconnected.

2. Description of the Prior Art

A number of connecting apparatuses have heretofore been provided which include male and female members engageable with each other. One such connecting apparatus for mounting an object on a belt is disclosed in my U.S. Pat. No. 5,347,693. In that apparatus, the female member defines a receptacle, and a male member has a part-circular head or button with a straight side which is slid into the receptacle through an open-top slot past a retaining structure which projects into the entry end of the slot. On entry into the receptacle, the head moves the retaining structure out of the way to permit passage. However, the retaining structure prevents movement of the head out of the receptacle in any but a single rotational orientation of the head. Several embodiments are disclosed, in one of which the retaining structure is a flexible prong unitary with the female structure and flexibly and resiliently movable between a locking position projecting into the entrance of the receptacle and a release position out of the entrance. This arrangement has the advantage of a unitary, one-piece female structure, but the retaining prong is a thin, narrow member which, with repeated flexing movement in use, is subject to considerable wear and ultimate breakage.

SUMMARY OF THE INVENTION

It is a general object of the invention to provide an improved apparatus for detachably interconnecting two objects, which avoids the disadvantages of prior apparatuses while affording additional structural and operating advantages.

An important feature of the invention is the provision of an apparatus of the type set forth which effectively prevents accidental disengagement of the apparatus, while being of simple and economical construction.

In connection with the foregoing features, another feature of the invention is the provision of an apparatus of the type set forth, which is resistant to wear.

Yet another feature of the invention is the provision of a unitary, one-piece, female connecting structure for an apparatus of the type set forth.

Certain ones of the these and other features of the invention may be attained by providing apparatus for detachably interconnecting two objects, comprising, in combination: a female structure adapted to be secured to one of the objects and defining a receptacle and an entrance leading into the receptacle, a male structure adapted to be secured to the other object and including a shank with an axis and an enlarged head on the shank adapted for movement into and out of the receptacle through the entrance and rotatable about the axis while in the receptacle, and flexible and resilient wedge structure integral with the female structure and laterally offset to one side of the entrance, the head being laterally truncated at one side of the axis so that while passing through the entrance in one rotational orientation the head will clear the wedge structure and in all other rotational orientations it will engage the wedge structure, said wedge structure being normally disposed in a locking position and being yieldably movable to a release position accommodating passage of said head into said receptacle through said entrance, whereby the head can be inserted into the receptacle in any rotational orientation and removed from the receptacle in only the one rotational orientation.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
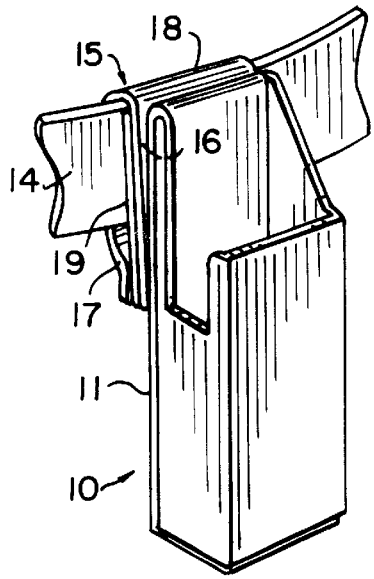
FIG. 1 is a perspective view of objects interconnected by the connecting apparatus of the present invention.
Figure 2:
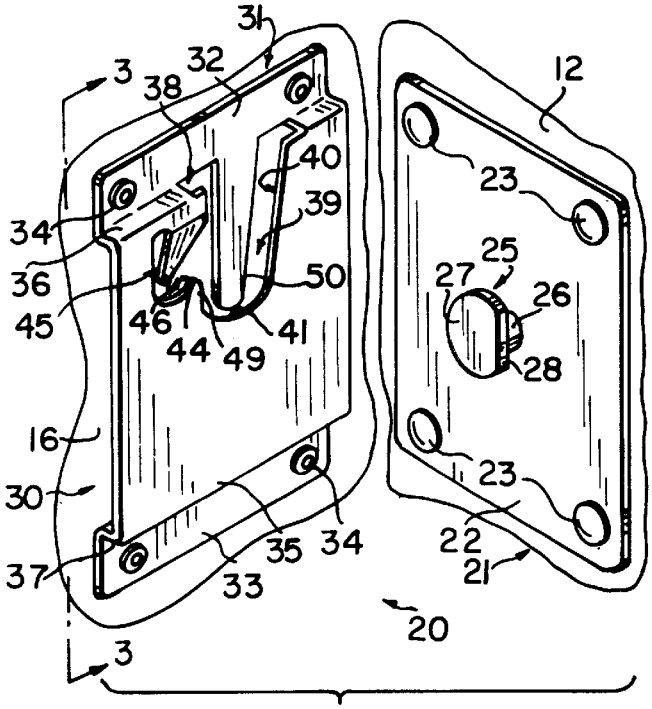
FIG. 2 is an enlarged, perspective view of the connecting apparatus of FIG. 1, with the objects separated and with the apparatus oriented in preparation for connection.
Figure 7:
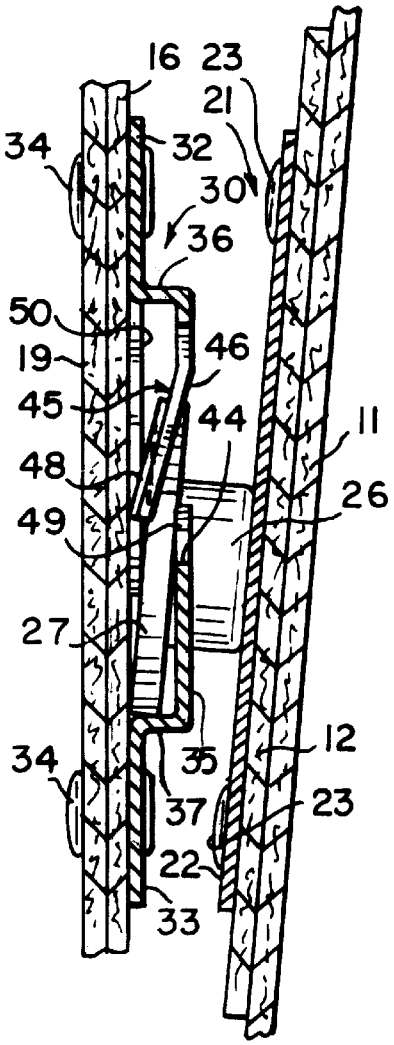
FIG. 7 is a further enlarged, fragmentary view in vertical section, taken generally along the line 7—7 in FIG. 5.
Figure 3:
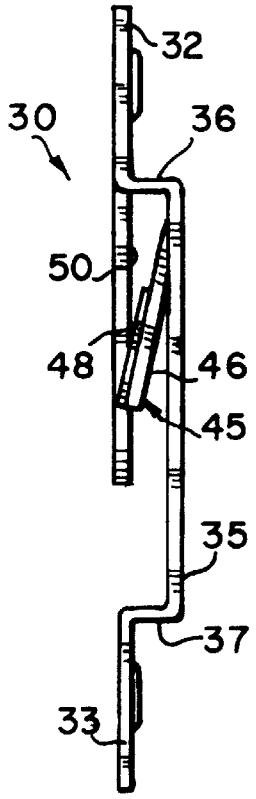
FIG. 3 is a further enlarged side elevational view of the female structure of the connecting apparatus, taken generally along the line 3—3 in FIG. 2.
Figure 6:
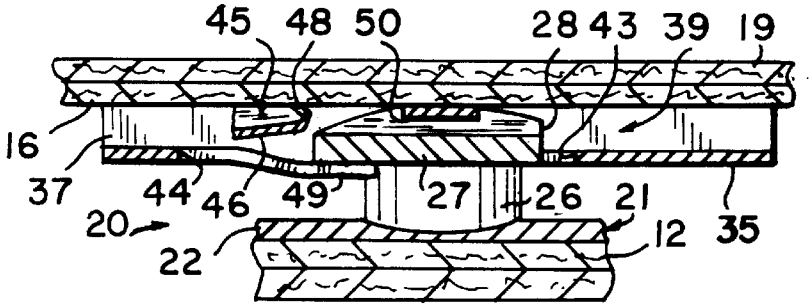
FIG. 6 is a further enlarged, fragmentary view in horizontal section, taken generally along the line 6—6 in FIG. 5.

Referring to FIG. 1, there is illustrated a holster, generally designated by the numeral 10, which may be of the type for carrying a mobile radio or pager or the like. The holster 10 has a rear wall 11 which may be provided with a stiffening plate 12 (see FIGS. 2 and 7). The holster 10 is adapted to be carried on a belt 14 by means of a hanger loop 15. The loop 15 comprises a folded-over length of material defining legs 16 and 17 joined by a bight 18. The distal ends of the legs 16 and 17 may be joined by any suitable means, such as snaps or the like (not shown). The inner surface of the leg 16 may be provided with a stiffening plate 19. The holster 10 and loop 15 are objects which can be interconnected by use of the present invention.

Referring now also to FIGS. 2–7, the holster 10 is adapted to be mounted on the hanger loop 15 by means of a connecting apparatus 20, constructed in accordance with and embodying the features of the present invention. More specifically, the connecting apparatus 20 includes a male structure 21, which is fixedly secured to the holster 10 and is adapted to mateably engage with a female structure 30, which is fixedly secured to the hanger loop 15 to permit quick and secure mounting and demounting of the holster 10 relative to the loop 15, as will be explained in greater detail below.

The male structure 21 includes a flat, rectangular base plate 22, which is fixedly secured to the stiffening plate 12 on the holster 10, as by rivets 23. Integral with the base plate 22 centrally thereof and projecting outwardly therefrom is a stud 25, which includes a circularly cylindrical shank 26 integral at its distal end with a disk-like, part-circular head 27, which is coaxial with the shank 26 and is truncated along a chord thereof to define a straight side edge 28.

The female structure 30 is preferably of unitary, one-piece construction, having a flat, substantially planar base wall 31, including spaced-apart and coplanar upper and lower rectangular portions 32 and 33 fixedly secured to the leg 16 and the stiffening plate 19 of the hanger loop 15, as by rivets 34. Offset forwardly a slight distance from the base wall 31 and substantially parallel thereto is a generally rectangular, flat, planar front wall 35, joined at its upper and lower edges to the lower and upper edges, respectively, of the base wall portions 32 and 33 by short rectangular shoulders 36 and 37. The upper shoulder 36 is cut away in a central region thereof to define an entrance slot 38 which opens into a receptacle 39.

Formed in the front wall 35 is an elongated aperture 40, the upper end of which opens at the entrance slot 38, and the lower end of which is defined by an arcuate seat 41. The aperture 40 has straight side edges 42 and 43 which, respectively, extend from the opposite ends of the seat 41 to the shoulder 36 and the entrance slot 38. The edge 42 preferably extends substantially perpendicular to the plane of the shoulder 36 and the edge 43 slopes upwardly and away from the edge 42 to define a guide surface, as will be explained more fully below.

Also formed through the front wall 35 is a generally V-shaped slot 44, the left leg of which is spaced laterally from and extends substantially parallel to the edge 42 of the aperture 40, and the right leg of which communicates with the aperture 40, intersecting the edge 42 intermediate its ends. The slot 44 serves to define a cam tab 45, which is generally triangular in shape, having an outer cam surface 46 and an inclined distal end 47 (see FIG. 4). Integral with the cam tab 45 at its distal end 47 and projecting rearwardly therefrom is a short flange 48. The cam tab 45 is bent out of the plane of the front wall 35 toward the base wall 31, so that the distal tip of the cam tab 45 lies substantially in the plane of the base wall 31 (see FIGS. 3 and 7). The right-hand leg of the slot 44 cooperates with the aperture 40 to define therebetween a stop finger 49. Unitary with the upper portion 32 of the base wall 31 and depending from the lower edge thereof in the plane thereof is an elongated backing arm 50, which is shaped similar to and aligned with the aperture 40. The receptacle 39 is generally the space between the front wall 35 and the backing arm 50.

Referring in particular to FIGS. 4–7, the operation of the connecting apparatus 20 will be described. It will be appreciated that the female structure 30 is mounted on the hanger loop 15 so that, in use, the receptacle 39 will open upwardly when the hanger loop 15 is mounted on the belt 14 of a user. Thus, the female structure 30 defines an open-top or top-loading receptacle 39. Furthermore, the male structure 21 is mounted on the holster 10 so that, when the holster 10 is in its normal upright position, illustrated in FIG. 1, the straight side edge 28 of the stud head 27 will be to the right, when the holster 10 is viewed from the front (see FIG. 5).

Figure 4:
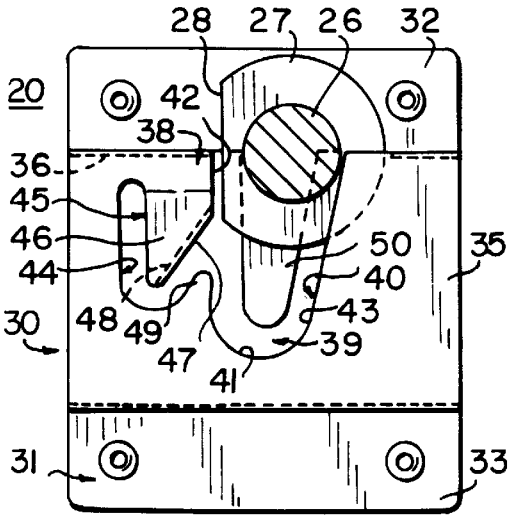
FIG. 4 is a further enlarged front elevational view of the connecting apparatus of FIG. 2, with the base plate of the male structure broken away showing the head of the male structure being inserted into the entrance of the receptacle in the female structure.

In use, the connecting apparatus 20 is initially positioned with the male structure 21 facing the female structure 30 so that the base plates 22 and 31 thereof are substantially parallel, and with the holster 10 upside down so that the straight side edge 28 of the shank head 27 is disposed toward the cam tab 45, as illustrated in FIG. 4. Then, the head 27 of the stud 25 is inserted into the entrance slot 38 of the receptacle 39 and slid downwardly, with the shank 26 extending through the aperture 40 in the front wall 35. In this regard, it will be appreciated that the head 27 has a thickness slightly less than the front-to-back depth of the entrance slot 38 and a diameter slightly less than the width of the entrance slot 38. The holster 10 and the attached male structure 21 are preferably held to the right, as viewed in FIG. 4, so that the stud shank 26 engages and rides along the guide edge 43 of the aperture 40. The parts are so dimensioned that, in this configuration, the straight side edge 28 of the stud head 27 will clear the left edge 42 of the aperture 40 and the cam tab 45, as can be seen in FIG. 4. The stud head 27 will be inserted downwardly into the receptacle 39 until the shank 26 bottoms against the seat 41 at the lower end of the aperture 40. It will be appreciated that, if the stud head 27 is inserted at the left-hand edge of the entrance slot 38, when the lower end of the straight side edge 28 engages the flange 48 on the cam tab 45 the tab 45 will yield to allow insertion of the head 27 into the receptacle 39.

Figure 5:
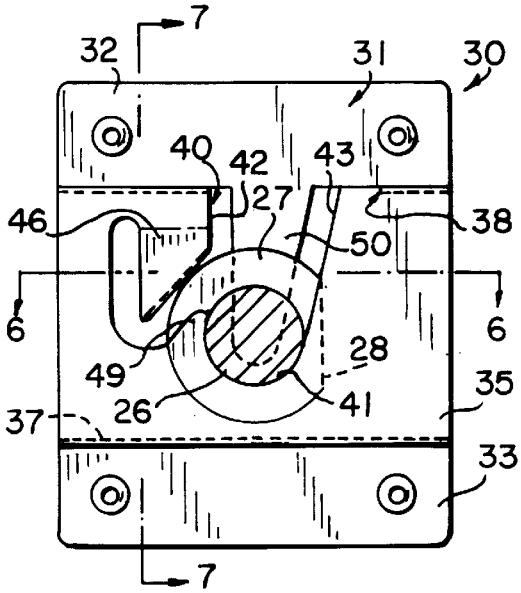
FIG. 5 is a view similar to FIG. 4, with the parts oriented in the connected condition of FIG. 1.

After the stud 25 has bottomed in the aperture 40, the holster 10 and the attached male structure 21 are rotated 180° clockwise, as viewed in FIG. 4, bringing the parts to the position illustrated in FIG. 5, wherein the straight side edge 28 of the stud head 27 faces away from the cam tab 45. In this position the holster 10 will be in its normal upright position, and the male structure 21 will be securely locked in the female structure 30. More specifically, the left-hand side of the stud head 27, as viewed in FIG. 5, will lie between the stop finger 49 and the cam tab 45. Preferably, the parts are so dimensioned that, when the stud head 27 is fully seated in the receptacle 39, the peripheral edge of the head 27 will be engageable with the flange 48 of the cam tab 45. In this configuration, the cam tab 45 cooperates with the stop finger 49 to form a wedge structure which effectively prevents removal of the stud 25 from the receptacle 39. Thus, if an attempt is made to move the stud 25 upwardly out of the receptacle 39, the left-hand side of the stud head 27, as viewed in FIG. 5, will cam up along the cam surface 46 or the flange 48 of the cam tab 45. Camming along the cam surface 46 will push the stud head 27 outwardly toward the front wall 35 and securely wedging the head 27 between the cam tab 45 and the stop finger 49, at the same time tending to tilt the stud head 27, as can best be seen in FIGS. 6 and 7. Camming along the flange 48 will push the stud downwardly and to the right, as viewed in FIG. 5, wedging the shank 26 against the receptacle seat 41 and the guide edge 43. It will be appreciated that, at the same time, the right-hand side of the stud head 27, as viewed in FIG. 5, will be wedged against the inner surface of the front wall 35. Accordingly, it will be appreciated that removal of the holster 10 from the hanger loop 15 is possible only by rotating it back to the rotational orientation illustrated in FIG. 4, so that the stud head 27 can clear the cam tab 45.

It is another aspect of the invention that the design of the parts is such as to permit insertion of the stud head 27 into the receptacle 39 in any orientation. If, for example, the user attempts to insert the stud head 27 through the entrance slot 38 when the stud head 27 is in the rotational orientation of FIG. 5, the stud head 27 will pass behind the cam tab 45. In this case, the cam tab 45 will be deflected forwardly toward the holster 10 to allow the stud head 27 to pass into the receptacle 39. The cam tab 45 and the stud head 27 are so dimensioned and arranged that, when the stud 25 is fully seated in the receptacle 39, as illustrated in FIG. 5, the stud head 27 will pass out from beneath the cam tab 45, allowing the cam tab 45 to return to its normal rest position. Thus, removal of the stud 25 from the receptacle 39 will be prevented in any but the rotational orientation of FIG. 4, in the same manner described above.

In a preferred embodiment of the invention, each of the male and female structures 21 and 30 is preferably formed of a suitable metal, such as a suitable steel, although it will be appreciated that other materials could be used.

From the foregoing, it can be seen that there has been provided an improved connecting apparatus including male and female structures, in which the structures are movable into and out of engagement with each other in only a single rotational orientation, the parts being of simple and economical construction.

While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Apparatus for detachably interconnecting two objects, comprising, in combination:

a female structure adapted to be secured to one of the objects and defining a receptacle and an entrance leading into the receptacle, a male structure adapted to be secured to the other object and including a shank with an axis and an enlarged head on said shank adapted for movement into and out of said receptacle through said entrance and rotatable about said axis while in said receptacle, and flexible and resilient wedge structure integral with said female structure and laterally offset to one side of the entrance, said head being laterally truncated at one side of said axis so that while passing through said entrance in one rotational orientation said head will clear said wedge structure and in all other rotational orientations it will engage said wedge structure, said wedge structure being normally disposed in a locking position and being yieldably movable to a release position accommodating passage of said head into said receptacle through said entrance, whereby said head can be inserted into the receptacle in any rotational orientation and removed from said receptacle in only said one rotational orientation.

2. The apparatus of claim 1, wherein said female structure is of unitary one-piece construction.

3. The apparatus of claim 1, wherein said head is movable into and out of said receptacle in directions substantially parallel to a predetermined plane, said wedge structure including a cam portion inclined with respect to said plane and projecting into said receptacle.

4. The apparatus of claim 1, wherein said female structure includes a front surface and an aperture in said front surface which communicates with said receptacle and extends to a peripheral edge of said front surface and has an open end at said peripheral edge defining said entrance, said aperture having a closed end defining a seat for said shank.

5. The apparatus of claim 4, wherein said female structure includes a guide edge along one side of said aperture opposite said wedge structure and extending from said entrance to said seat for guiding movement of said shank as said head is moved into said receptacle.

6. The apparatus of claim 4, wherein said female structure includes a backing portion spaced from said front surface and disposed opposite said aperture for supporting said head during movement into and out of said receptacle.

7. Apparatus for detachably interconnecting two objects, comprising, in combination:

a female structure adapted to be secured to one of the objects and defining a receptacle bounded by a substantially planar wall and an entrance leading into the receptacle, a male structure adapted to be secured to the other object and including a shank with an axis and an enlarged head on said shank adapted for movement into and out of said receptacle through said entrance in directions substantially parallel to said planar wall and rotatable about said axis while in said receptacle, a cam portion integral with said female structure and projecting into said receptacle from said planar wall, and a stop portion on said planar wall, said cam portion and said stop portion being laterally offset to one side of the entrance, said head being laterally truncated to one side of said axis so that while passing through said entrance in one rotational orientation said head will clear said cam portion and said stop portion, said head when disposed in said receptacle in any other rotational orientation being responsive to movement towards said entrance for engagement with said cam portion to wedge said head between said cam and stop portions, thereby effectively preventing removal of said head from said receptacle.

8. The apparatus of claim 7, wherein said female structure is of unitary one-piece construction.

9. The apparatus of claim 7, wherein said cam portion extends in the direction of said axis entirely across said receptacle so as to be engageable by said head in any but said one rotational orientation to inhibit movement of said head out of said receptacle.

10. The apparatus of claim 7, wherein said female structure includes a substantially planar front wall including said stop portion, said cam portion being integral with said front wall and extending out of the plane thereof into said receptacle.

11. The apparatus of claim 10, wherein said female structure includes a support arm spaced from said front wall and extending parallel thereto along the rear of said receptacle for supporting said head during movement into and out of said receptacle.

12. The apparatus of claim 10, wherein said front wall has an aperture therein communicating with said receptacle and extending to a peripheral edge of said front wall and opening at said peripheral edge to define said entrance, said aperture defining a seat for said shank opposite said entrance.

13. The apparatus of claim 12, wherein said female structure includes a support arm spaced from said front wall and extending parallel thereto along the rear of said receptacle for supporting said head during movement into and out of said receptacle.

14. A one-piece female connector structure adapted for cooperation with an associated male connector structure for interconnecting objects, said female structure comprising:

a member including first and second interconnected and substantially parallel planar walls respectively living in separate planes and cooperating to define therebetween a receptacle, said first wall having an aperture therein communicating with the receptacle and extending to a peripheral edge of said first wall and having an entrance which opens at said peripheral edge, and a cam portion on said first wall inclined from the plane of said first wall into the receptacle and toward the plane of the second wall, said cam portion being laterally offset to one side of the aperture.

15. The structure of claim 14, wherein said second wall includes first and second spaced-apart and substantially coplanar portions, said first wall extending between said portions.

16. The structure of claim 15, wherein said second wall includes a support arm projecting from one of said portions opposite said aperture.

17. The structure of claim 14, wherein said cam portion is inclined with respect to the plane of said first wall.

18. The structure of claim 14, wherein said cam structure has a lip thereon at a distal end thereof extending toward said second wall.

19. The structure of claim 14, wherein said aperture defines a seat opposite said entrance.

20. The structure of claim 19, wherein said first wall includes a guide edge extending along one side of said aperture from said seat to said entrance opposite said cam portion.

* * * * *

UNITED STATES PATENT AND TRADEMARK OFFICE

CERTIFICATE OF CORRECTION

PATENT NO. : 5,839,173

DATED : November 24, 1998

INVENTOR(S) : Edward C. Otrusina

It is certified that error appears in the above-indentified patent and that said Letters Patent is hereby corrected as shown below:

Column 7, line 10, "living" should be --lying--.

Signed and Sealed this

Twenty-ninth Day of June, 1999

*Attest:*

Q. TODD DICKINSON

*Attesting Officer*

*Acting Commissioner of Patents and Trademarks*